US007080887B2

(12) United States Patent
Tseng

(10) Patent No.: US 7,080,887 B2
(45) Date of Patent: Jul. 25, 2006

(54) CHAIR WITH FOLDABLE LEG REST

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 386 days.

(21) Appl. No.: 10/641,245

(22) Filed: Aug. 14, 2003

(65) Prior Publication Data

US 2005/0035645 A1 Feb. 17, 2005

(51) Int. Cl.
*A47C 20/00* (2006.01)

(52) U.S. Cl. ..... 297/423.19; 297/69; 297/423.28

(58) Field of Classification Search ..... 297/69, 297/75, 423.19, 423.26, 423.28, 423.3, 423.36, 297/85, 89
See application file for complete search history.

(56) References Cited

U.S. PATENT DOCUMENTS 3,016,265 A * 1/1962 Cobb ..... 297/88
3,087,757 A * 4/1963 Fidel ..... 297/423.28
3,429,612 A * 2/1969 Cobb ..... 297/75
5,120,107 A * 6/1992 Rogers, Jr. ..... 297/68
5,782,535 A * 7/1998 Lafer ..... 297/423.36
5,890,766 A * 4/1999 Tsai ..... 297/423.28
6,155,645 A * 12/2000 Bedrich ..... 297/423.28
6,572,185 B1 * 6/2003 Tseng ..... 297/85

* cited by examiner

*Primary Examiner*—Laurie K. Cranmer
(74) *Attorney, Agent, or Firm*—Ladas & Parry LLP

(57) ABSTRACT

A chair includes a base frame unit, a leg rest frame, an operating unit, and a linkage device. The base frame unit includes a seat frame with front and rear frame portions. The leg rest frame is connected pivotally to the front frame portion of the seat frame, and is pivotable relative to the seat frame between a folded position, where the leg rest frame is disposed under the seat frame and is generally parallel to the seat frame, and an unfolded position, where the leg rest frame is generally coplanar with the seat frame. The operating unit is mounted rotatably on the base frame unit. The linkage device interconnects the operating unit and the leg rest frame, and is responsive to operation of the operating unit for moving the leg rest frame between the folded and unfolded positions.

7 Claims, 6 Drawing Sheets

CHAIR WITH FOLDABLE LEG REST

BACKGROUND OF THE INVENTION

1. Field of the Invention

The present invention relates to a chair, more particularly to a chair with a foldable leg rest.

2. Description of the Related Art

A chair having a leg rest that can be moved between extended and folded positions is known in the art. However, when the leg rest is at the folded position, the legs of the user will touch the leg rest, which can result in discomfort. Moreover, the leg rest hinders cleaning of the under side of the chair when at the folded position.

SUMMARY OF THE INVENTION

Therefore, the object of the present invention is to provide a chair that can overcome the aforesaid drawbacks of the prior art.

Accordingly, the chair of the present invention comprises a base frame unit, a leg rest frame, an operating unit, and a linkage device.

The base frame unit includes a seat frame with front and rear frame portions. The leg rest frame is connected pivotally to the front frame portion of the seat frame, and is pivotable relative to the seat frame about a pivot axis between a folded position, where the leg rest frame is disposed under the seat frame and is generally parallel to the seat frame, and an unfolded position, where the leg rest frame is generally coplanar with the seat frame. The operating unit includes a drive shaft and an operating lever. The drive shaft extends along a shaft axis parallel to the pivot axis, is mounted rotatably on the base frame unit, and is disposed rearwardly of the pivot axis. The operating lever is connected to one end of the drive shaft, and is operable so as to drive rotation of the drive shaft about the shaft axis. The linkage device interconnects the drive shaft and the leg rest frame, and is responsive to rotation of the drive shaft so as to drive movement of the leg rest frame from one of the folded and unfolded positions to the other of the folded and unfolded positions.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
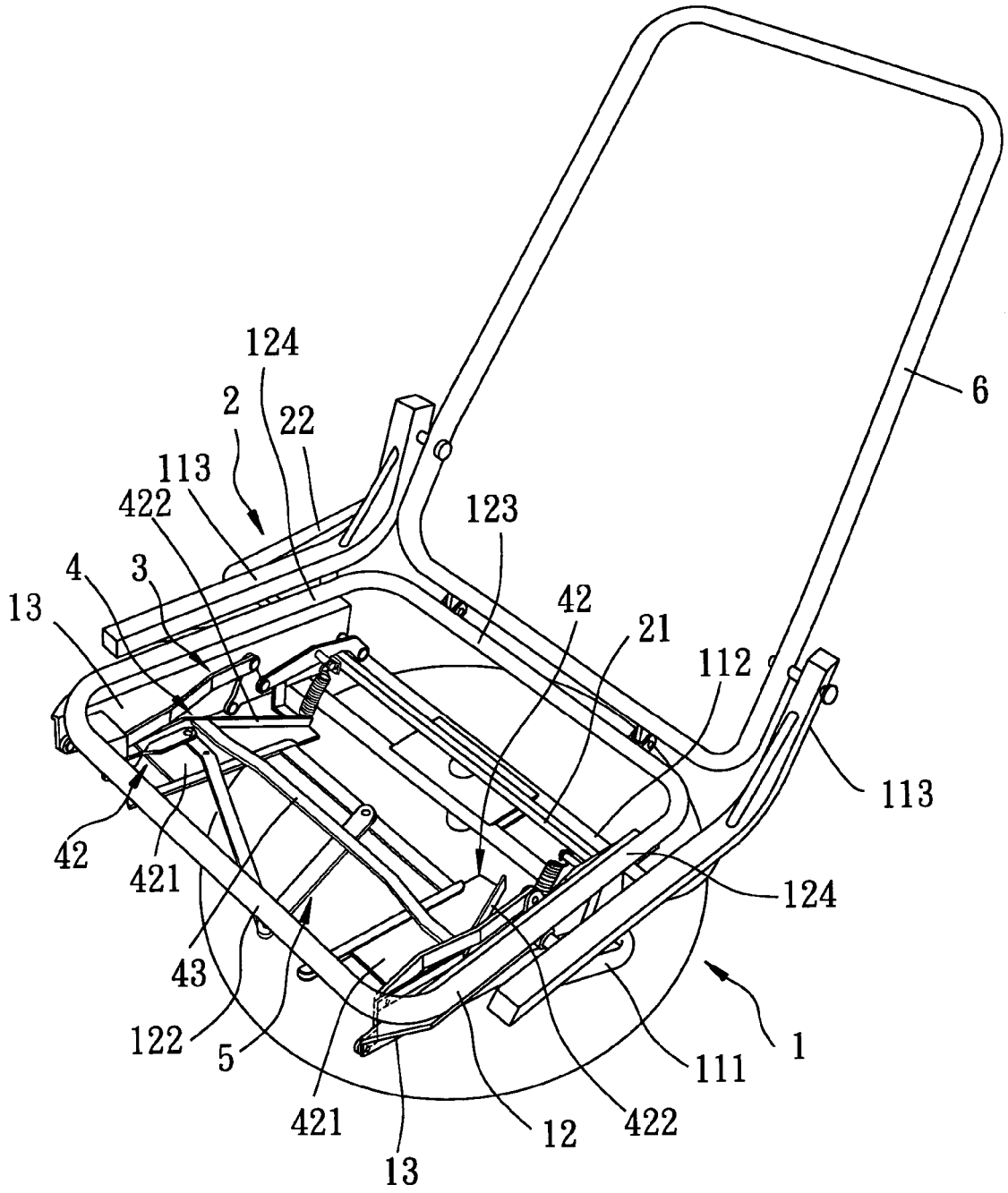
FIG. 1 is an assembled perspective view of the preferred embodiment of a chair according to the present invention, illustrating a leg rest frame thereof at a folded position.
Figure 2:
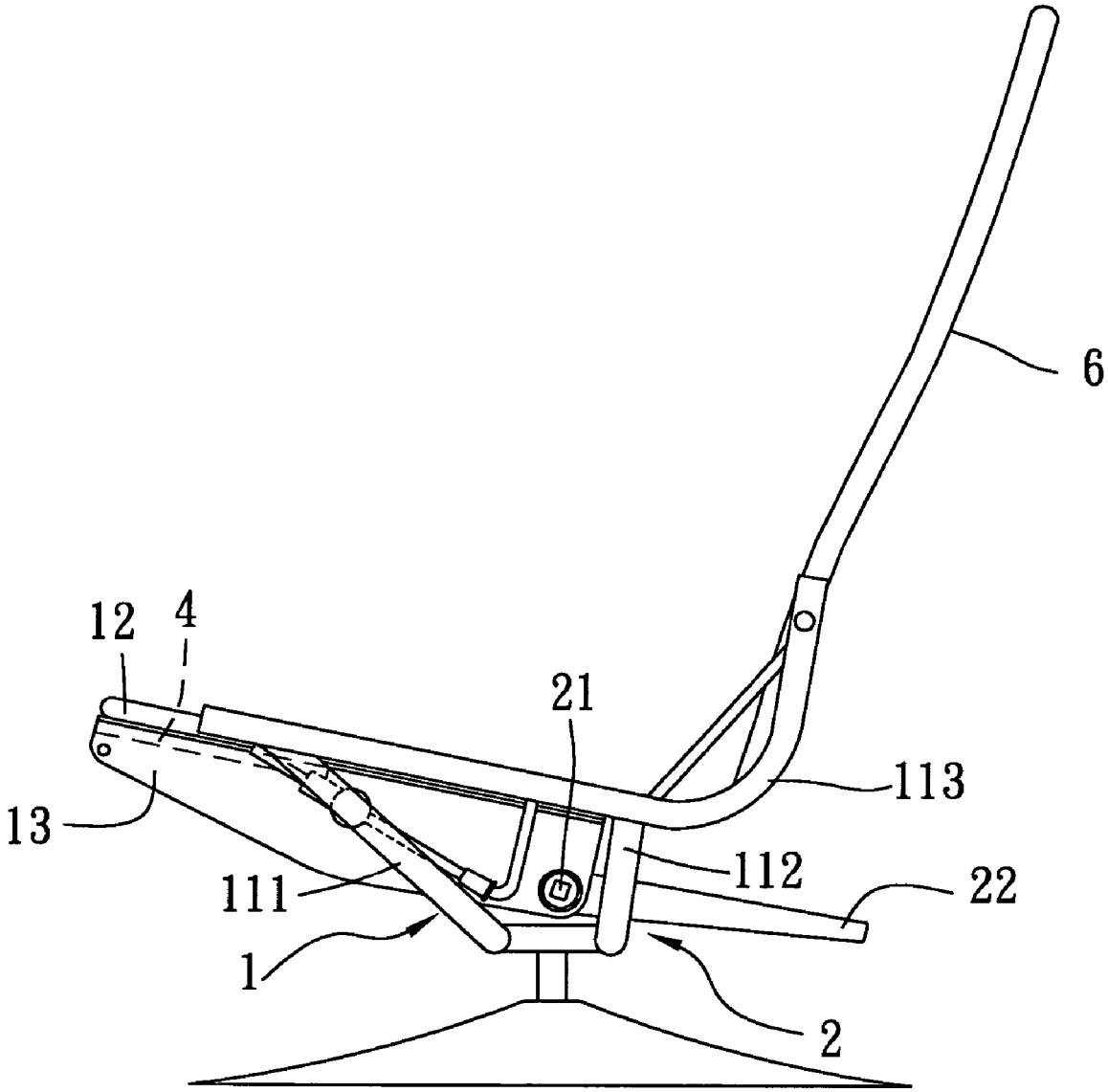
FIG. 2 is a schematic side view of the preferred embodiment.

Referring to FIG. 1, the preferred embodiment of a chair according to the present invention is shown to include a base frame unit 1, a leg rest frame 4, an operating unit 2, a pair of linkage devices 3, an extender frame unit 5, and a back frame 6. The chair of the preferred embodiment is illustrated in FIGS. 1 to 6 with upholstery removed therefrom for the sake of clarity.

The base frame unit 1 includes a support frame 11 (see FIG. 5) and a seat frame 12. The support frame 11 includes U-shaped front and rear frame members 111, 112, and L-shaped left and right frame members 113. The front frame member 111 inclines forwardly, and has a pair of distal ends connected respectively to the left and right frame members 113. The rear frame member 112 is disposed rearwardly of the front frame member 112, extends uprightly, and similarly has a pair of distal ends connected respectively to the left and right frame members 113. The seat frame 12 is rectangular in shape, is mounted on the support frame 11, and includes front and rear frame portions 122, 123, and a pair of lateral frame portions 124 interconnecting the front and rear frame portions 122, 123. A mounting plate 13 is fixed on a lower side of each of the lateral frame portions 124.

The leg rest frame 4 is connected pivotally to the front frame portion 122 of the seat frame 12, and is pivotable relative to the seat frame 12 about a first pivot axis 40 (see FIGS. 3 to 6) between a folded position, where the leg rest frame 4 is disposed under the seat frame 12 and is generally parallel to the seat frame 12, and an unfolded position (see FIG. 3), where the leg rest frame 4 is generally coplanar with the seat frame 12. The preferred configuration of the leg rest frame 4 will be described in greater detail in the succeeding paragraphs.

The operating unit 2 includes a drive shaft 21 and an operating lever 22. The drive shaft 21 extends along a shaft axis parallel to the first pivot axis 40, is mounted rotatably on the mounting plates 13 of the base frame unit 1, and is disposed rearwardly of the first pivot axis 40. The operating lever 22 is connected to one end of the drive shaft 21, and is operable so as to drive rotation of the drive shaft 21 about the shaft axis. The operating lever 22 may be connected to either end of the drive shaft 21.

Figure 4:
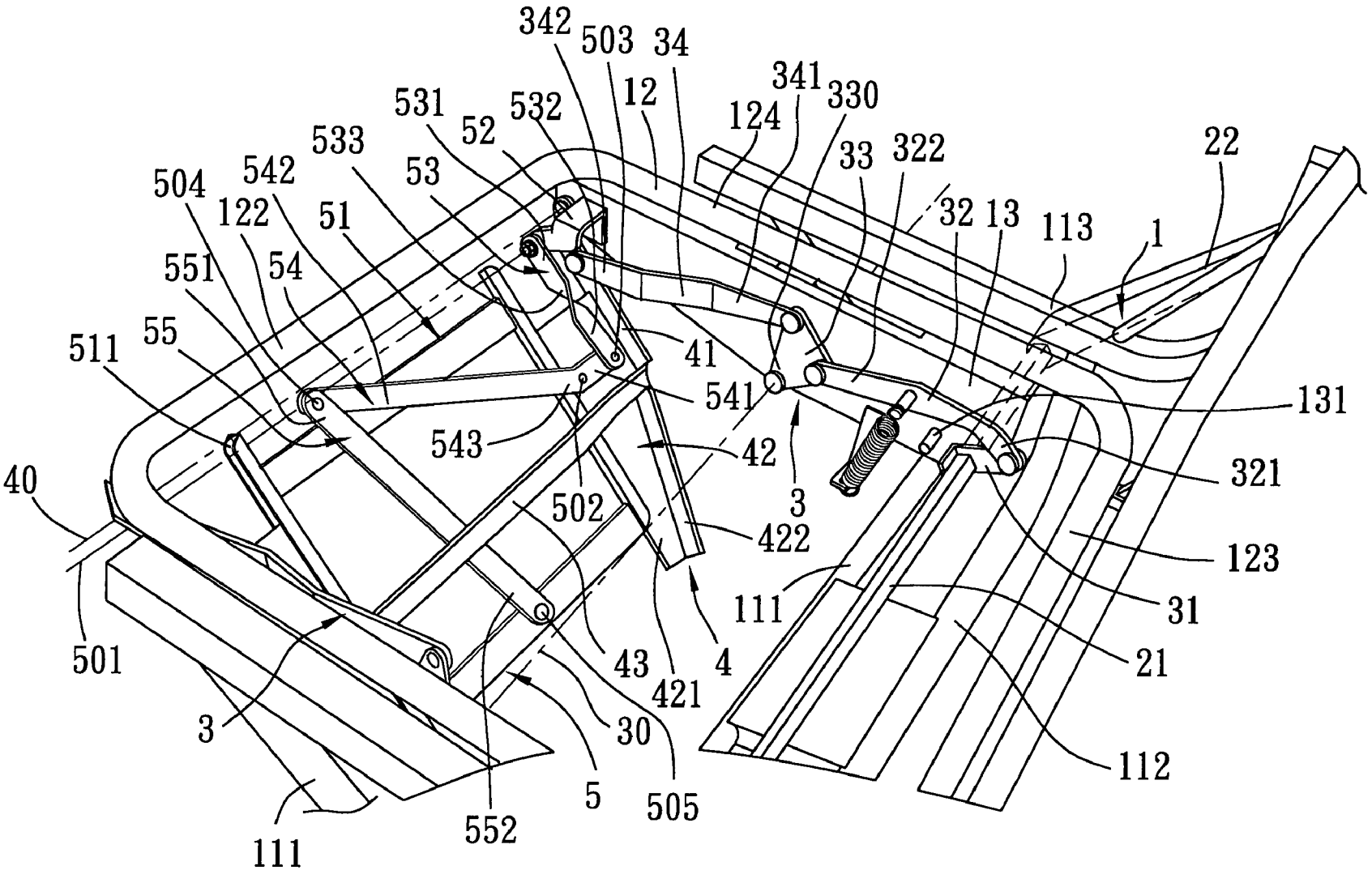
FIG. 4 is a fragmentary perspective view of the preferred embodiment, illustrating a linkage device thereof when the leg rest frame is close to the folded position.

Each of the linkage devices 3 interconnects the drive shaft 21 and the leg rest frame 4, and is responsive to rotation of the drive shaft 21 so as to drive movement of the leg rest frame 4 from one of the folded and unfolded positions to the other of the folded and unfolded positions. Referring further to FIG. 4, each of the linkage devices 3 includes a first link member 31, a second link member 32, a third link member 33, and a fourth link member 34.

The first link member 31 has a first link end connected co-rotatably to the drive shaft 21, and a second link end. The second link member 32 has a rear link end 321 connected pivotally to the second link end of the first link member 31, and a front link end 322. The third link member 33 has a first link portion connected pivotally to the front link end 322 of the second link member 32, a second link portion, and an intermediate link portion 330 between the first and second link portions and connected pivotally to a respective one of the mounting plates 13 of the base frame unit 1. In this embodiment, the third link member 33 is a triangular plate, and the intermediate link portion 330 is disposed below the first and second link portions. The third link members 33 of the linkage devices 3 are pivotable relative to the base frame unit 1 about a pivot axis 30. The fourth link member 34 has a rear link section 341 connected pivotally to the second link portion of the third link member 33, and a front link section 342 connected pivotally to the leg rest frame 4.

Preferably, each of the mounting plates 13 of the base frame unit 1 is provided with a stop projection 131 for arresting further rotation of the first link member 31 of the adjacent linkage device 3 when the leg rest frame 4 is at the unfolded position.

Figure 5:
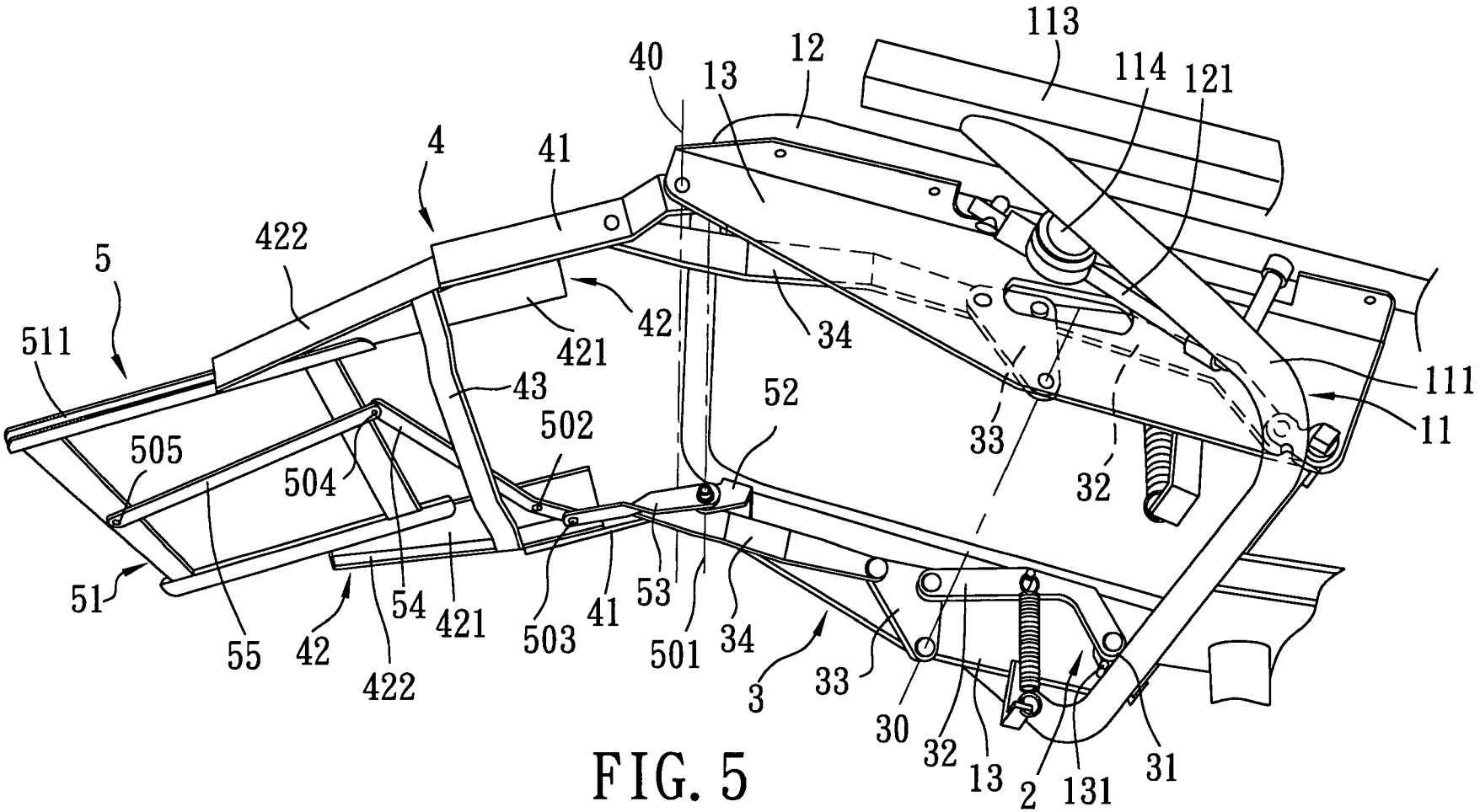
FIG. 5 is a fragmentary bottom perspective view of the preferred embodiment, illustrating the components thereof when the leg rest frame is close to the unfolded position.

With further reference to FIG. 5, the leg rest frame 4 includes a pair of lateral frame members 41, each of which has a rear frame end connected pivotally to a respective one of the mounting plates 13 of the base frame unit 1 such that the lateral frame members 41 are connected pivotally to the front frame portion 122 of the seat frame 12 through the mounting plates 13 and such that the lateral frame members 41 are pivotable relative to the seat frame 12 about the first pivot axis 40. The front link section 342 of the fourth link member 34 of each of the linkage devices 3 is connected pivotally to an intermediate portion of a respective one of the lateral frame members 41 of the leg rest frame 4. Therefore, movement of the linkage devices 3 in response to operation of the operating unit 2 can result in pivoting movement of the lateral frame members 41 about the first pivot axis 40. Each of a pair of wing plates 42 serves as a front frame end of a respective one of the lateral frame members 41, and includes a plate portion 421 and a coupling portion 422 transverse to the plate portion 421. A bracing rod 43 interconnects the coupling portions 422 of the wing plates 42.

The extender frame unit 5 includes an extender frame member 51 and a linkage mechanism constituted by first, second and third links 53, 54, 55.

Figure 3:
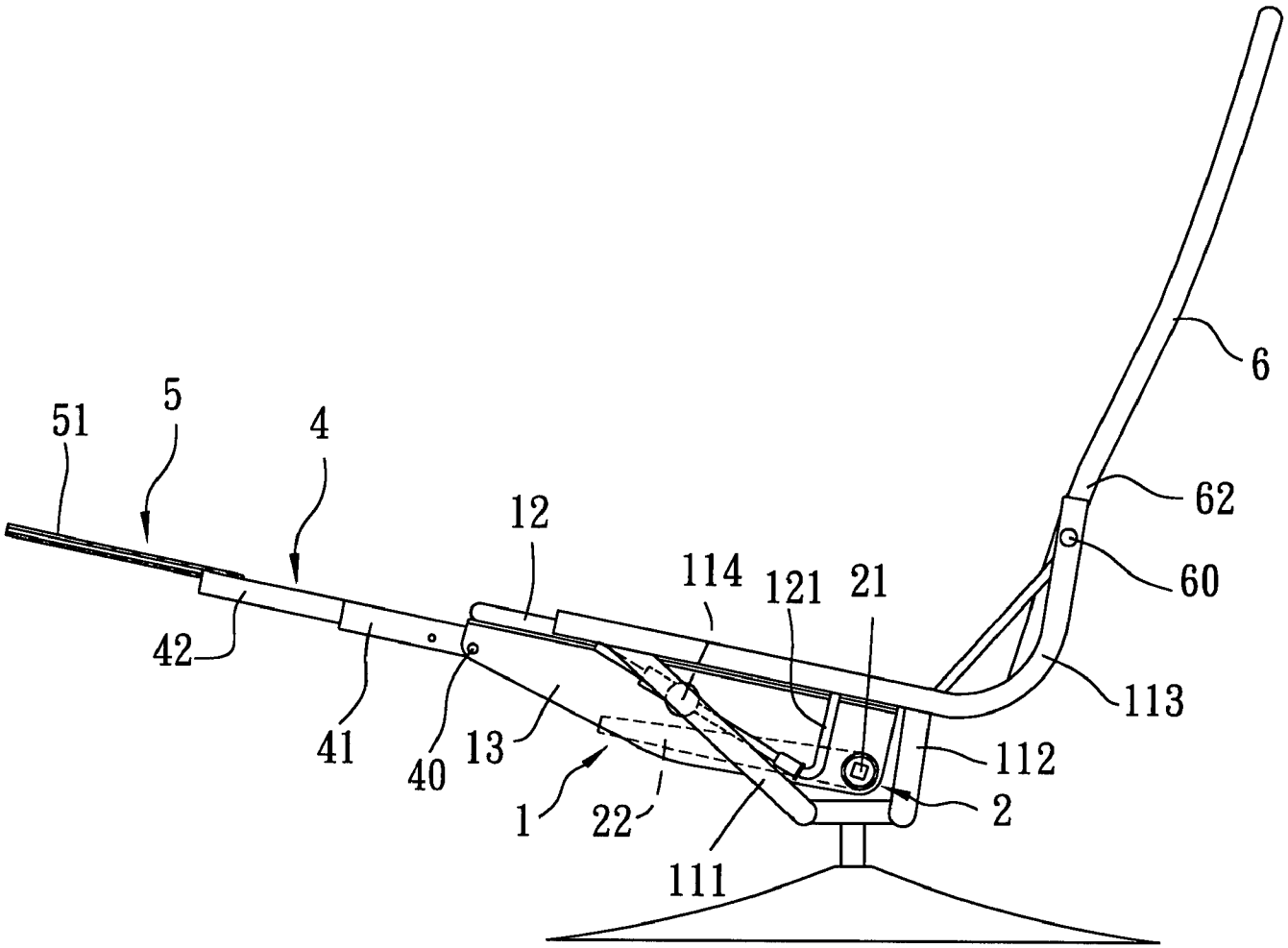
FIG. 3 is a view similar to FIG. 2, illustrating the leg rest frame at an unfolded position.
Figure 6:
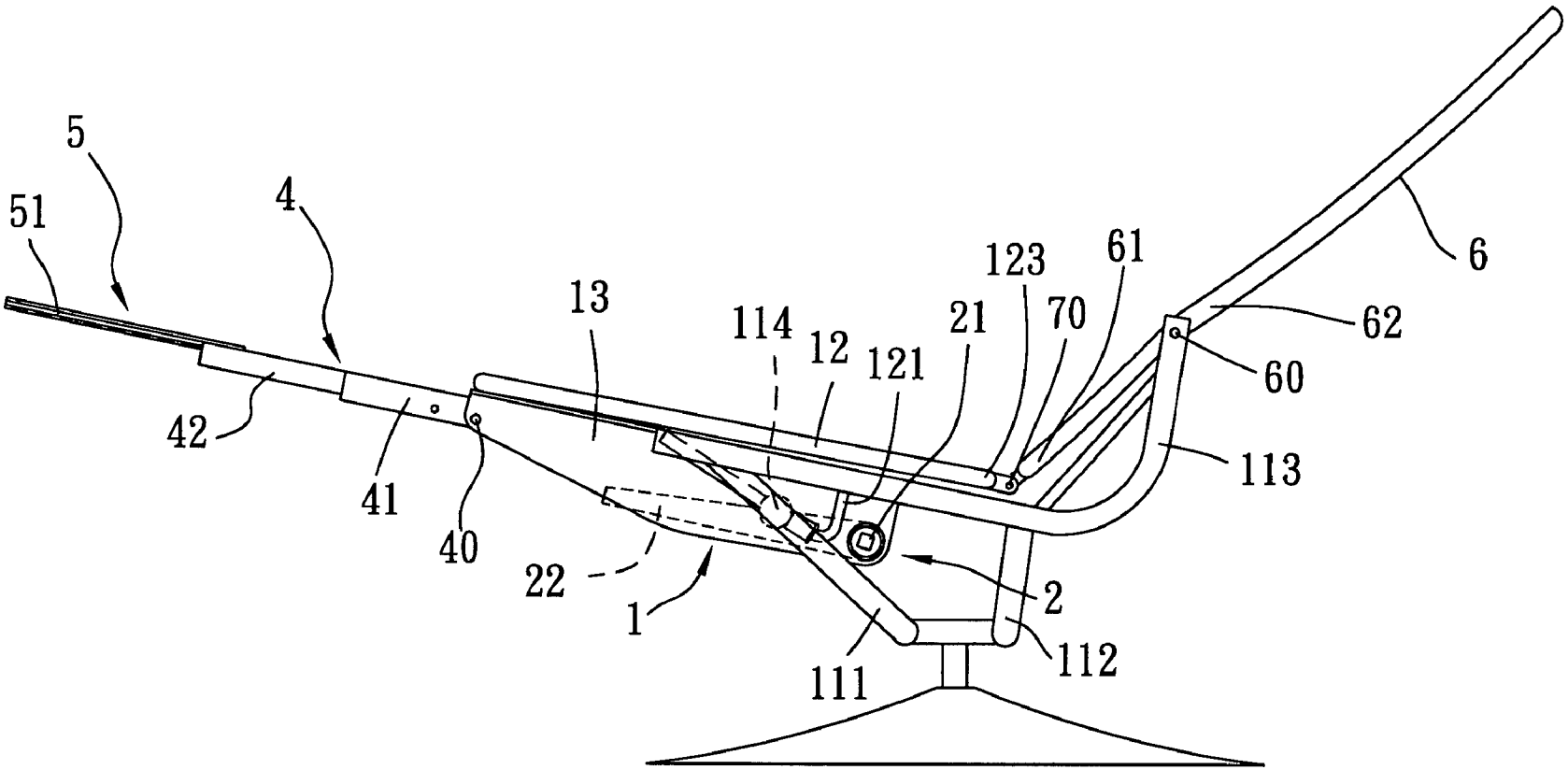
FIG. 6 is a view similar to FIG. 3, illustrating a back frame thereof at a tilted position.

The extender frame member 51 has opposite lateral edges formed with slide grooves 511 for sliding engagement with the plate portions 421 of the wing plates 42 of the lateral frame members 41 of the leg rest frame 4. The extender frame member 51 is thus movable relative to the leg rest frame 4 from a retracted position, where the extender frame member 51 is retracted relative to the front frame ends of the lateral frame members 41, as shown in FIG. 4, and an extended position, where the extender frame member 51 is extended relative to the front frame ends of the lateral frame members 41, as shown in FIGS. 3, 5 and 6.

The linkage mechanism interconnects the extender frame member 51, the leg rest frame 4, and the base frame unit 1 such that movement of the leg rest frame 4 to the unfolded position results in simultaneous movement of the extender frame member 51 to the extended position.

The first link 53 of the linkage mechanism has a first link end 531 mounted pivotally on the base frame unit 1 by means of an inverted U-shaped bracket 52 fixed to one of the mounting plates 13, a second link end 532, and a twisted intermediate segment 533 between the first and second link ends 531, 532 such that the second link end 532 extends generally perpendicular to the first link end 531. Accordingly, the first link 53 is pivotable relative to the base frame unit 1 about a first link axis 501 parallel to the first pivot axis 40.

The second link 54 of the linkage mechanism has a third link end 541 connected pivotally to the second link end 532 of the first link 53 such that the second link 54 is pivotable relative to the first link 53 about a second link axis 503 transverse to the first link axis 501, a fourth link end 542, and an angled intermediate segment 543 between the third and fourth link ends 541, 542 and connected pivotally to the plate portion 421 of the wing plate 42 on one of the lateral frame members 41 of the leg rest frame 4 such that the second link 54 is pivotable relative to the leg rest frame 4 about a third link axis 502 parallel to the second link axis 503.

The third link 55 of the linkage mechanism has a fifth link end 551 connected pivotally to the fourth link end 542 of the second link 54 such that the third link 55 is pivotable relative to the second link 54 about a fourth link axis 504 parallel to the second link axis 503, and a sixth link end 552 connected pivotally to the extender frame member 51 such that the third link 55 is pivotable relative to the extender frame member 51 about a fifth link axis 505 parallel to the second link axis 503.

Referring to FIGS. 4 and 5, when it is desired to move the leg rest frame 4 from the folded position to the unfolded position, the operating lever 22 is operated to rotate the drive shaft 21 such that the first link members 31 of the linkage devices 3 rotate forwardly with the drive shaft 21. At this time, the second link members 32 of the linkage devices 3 move forward and cause the third link members 33 to pivot forward about the pivot axis 30, thereby moving the fourth link members 34 forward. Since the fourth link members 34 of the linkage devices 3 are connected pivotally and respectively to the lateral frame members 41 of the leg rest frame 4, the leg rest frame 4 will be driven to pivot about the first pivot axis 40 from the folded position to the unfolded position. When the leg rest frame 4 reaches the unfolded position, the first link members 31 will abut against the stop projections 131 on the mounting plates 13 of the base frame unit 1, thereby arresting further movement of the linkage devices 3 and the leg rest frame 4.

As the leg rest frame 4 moves from the folded position to the unfolded position, the extender frame member 51 will move simultaneously from the retracted position to the extended position. Particularly, since the second link 54 is connected to and is pivotable relative to the wing plate 42 on one of the lateral frame members 41 of the leg rest frame 4 about the link axis 502, movement of the leg rest frame 4 results in corresponding movement of the second link 54. Since the first link 53 is connected pivotally to the second link 54, movement of the second link 54 with the leg rest frame 4 results in pivoting movement of the first link 53 about the link axis 501. Moreover, since the link axis 501 is disposed rearwardly of the first pivot axis 40, when the leg rest frame 4 pivots from the folded position to the unfolded position, the second link 54 will pivot about the link axis 502 accordingly. In view of the angled configuration of the second link 54, pivoting movement of the second link 54 at this time will result in a forward pushing force on the third link 53 for moving the extender frame member 51 from the retracted position to the extended position.

Based on the aforesaid operating principle, when the operating lever 22 is operated in a reverse direction, the leg rest frame 4 will be moved from the unfolded position to the folded position, and the extender frame unit 5 will be moved simultaneously from the extended position to the retracted position.

Referring once again to FIGS. 3, 5 and 6, the back frame 6 is mounted on and extends upwardly from the support frame 11 of the base frame unit 1. In this embodiment, the seat frame 12 further includes a pair of slide rods 121, each of which extends from a lower side of a respective one of the lateral frame portions 124. The front frame member 111 of the support frame 11 has a pair of slide sleeves 114 sleeved on and in sliding engagement with the slide rods 121, respectively. In this manner, the seat frame 12 is mounted movably on the support frame 11 and is movable between a front frame position (see FIG. 6) and a rear frame position (see FIG. 3) on the support frame 11. The back frame 6 has a lower frame section 61 (see FIG. 6) connected pivotally to the rear frame portion 123 of the seat frame 12 and pivotable relative to the seat frame 12 about a second pivot axis 70 parallel to the first pivot axis 40 (see FIG. 5), and an upper frame section 62 connected pivotally to the left and right frame members 113 of the support frame 11 and pivotable relative to the support frame 11 about a third pivot axis 60 disposed above and parallel to the second pivot axis 70, as best shown in FIG. 6. Therefore, movement of the back frame 6 from an upright position (see FIG. 3) to a tilted position (see FIG. 6) relative to the support frame 11 in response to pressure applied on the back frame 6 results in corresponding movement of the seat frame 12 from the rear frame position (see FIG. 3) to the front frame position (see FIG. 6).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A chair comprising:

a base frame unit including a seat frame with front and rear frame portions;

a leg rest frame connected pivotally to said front frame portion of said seat frame and pivotable relative to said seat frame about a first pivot axis between a folded position, where said leg rest frame is disposed under said seat frame and is generally parallel to said seat frame, and an unfolded position, where said leg rest frame is generally coplanar with said seat frame;

an operating unit including a drive shaft extending along a shaft axis parallel to the first pivot axis, mounted rotatably on said base frame unit, and disposed rearwardly of the first pivot axis, and an operating lever connected to one end of said drive shaft and operable so as to drive rotation of said drive shaft about the shaft axis; and a linkage device interconnecting said drive shaft and said leg rest frame, said linkage device being responsive to rotation of said drive shaft so as to drive movement of said leg rest frame from one of the folded and unfolded positions to the other of the folded and unfolded positions;

wherein said linkage device includes:

a first link member having a first link end connected co-rotatably to said drive shaft, and a second link end;

a second link member having a rear link end connected pivotally to said second link end, and a front link end;

a third link member having a first link portion connected pivotally to said front link end, a second link portion, and an intermediate link portion between said first and second link portions and connected pivotally to said base frame unit; and a fourth link member having a rear link section connected pivotally to said second link portion, and a front link section connected pivotally to said leg rest frame.

2. The chair as claimed in claim 1, wherein said third link member is a triangular plate and said intermediate link portion is disposed below said first and second link portions.

3. The chair as claimed in claim 1, wherein said base frame unit is provided with a stop projection for arresting further rotation of said first link member when said leg rest frame is at the unfolded position.

4. A chair comprising:

a base frame unit including a seat frame with front and rear frame portions;

a leg rest frame connected pivotally to said front frame portion of said seat frame and pivotable relative to said seat frame about a first pivot axis between a folded position, where said leg rest frame is disposed under said seat frame and is generally parallel to said seat frame, and an unfolded position, where said leg rest frame is generally coplanar with said seat frame;

an operating unit including a drive shaft extending along a shaft axis parallel to the first pivot axis, mounted rotatably on said base frame unit, and disposed rearwardly of the first pivot axis, and an operating lever connected to one end of said drive shaft and operable so as to drive rotation of said drive shaft about the shaft axis; and a linkage device interconnecting said drive shaft and said leg rest frame, said linkage device being responsive to rotation of said drive shaft so as to drive movement of said leg rest frame from one of the folded and unfolded positions to the other of the folded and unfolded positions;

wherein said base frame unit is provided with a stop projection for arresting further movement of said linkage device when said leg rest frame is at the unfolded position.

5. A chair comprising:

a base frame unit including a seat frame with front and rear frame portions;

a leg rest frame connected pivotally to said front frame portion of said seat frame and pivotable relative to said seat frame about a first pivot axis between a folded position, where said leg rest frame is disposed under said seat frame and is generally parallel to said seat frame, and an unfolded position, where said leg rest frame is generally coplanar with said seat frame;

an operating unit including a drive shaft extending along a shaft axis parallel to the first pivot axis, mounted rotatably on said base frame unit, and disposed rearwardly of the first pivot axis, and an operating lever connected to one end of said drive shaft and operable so as to drive rotation of said drive shaft about the shaft axis; and a linkage device interconnecting said drive shaft and said leg rest frame, said linkage device being responsive to rotation of said drive shaft so as to drive movement of said leg rest frame from one of the folded and unfolded positions to the other of the folded and unfolded positions;

wherein said leg rest frame includes a pair of lateral frame members, each of which has a rear frame end connected pivotally to said front frame portion of said seat frame, and a front frame end, said chair further comprising an extender frame unit, said extender frame unit including an extender frame member having opposite lateral edges in sliding engagement with said lateral frame members, respectively, said extender frame member being movable relative to said leg rest frame from a retracted position, where said extender frame member is retracted relative to said front frame ends of said lateral frame members, and an extended position, where said extender frame member is extended relative to said front frame ends of said lateral frame members, and a linkage mechanism interconnecting said extender frame member, said leg rest frame, and said base frame unit such that movement of said leg rest frame to the unfolded position results in simultaneous movement of said extender frame member to the extended position.

6. The chair as claimed in claim 5, wherein said linkage mechanism includes:

a first link having a first link end mounted pivotally on said base frame unit and pivotable about a first link axis parallel to the first pivot axis, a second link end, and a twisted intermediate segment between said first and second link ends such that said second link end extends generally perpendicular to said first link end;

a second link having a third link end connected pivotally to said second link end such that said second link is pivotable relative to said first link about a second link axis transverse to the first link axis, a fourth link end, and an angled intermediate segment between said third and fourth link ends and connected pivotally to one of said lateral frame members of said leg rest frame such that said second link is pivotable relative to said leg rest frame about a third link axis parallel to the second link axis; and a third link having a fifth link end connected pivotally to said fourth link end of said second link such that said third link is pivotable relative to said second link about a fourth link axis parallel to the second link axis, and a sixth link end connected pivotally to said extender frame member such that said third link is pivotable relative to said extender frame member about a fifth link axis parallel to the second link axis.

7. A chair comprising:

a base frame unit including a seat frame with front and rear frame portions;

a leg rest frame connected pivotally to said front frame portion of said seat frame and pivotable relative to said seat frame about a first pivot axis between a folded position, where said leg rest frame is disposed under said seat frame and is generally parallel to said seat frame, and an unfolded position, where said leg rest frame is generally coplanar with said seat frame;

an operating unit including a drive shaft extending along a shaft axis parallel to the first pivot axis, mounted rotatably an said base frame unit, and disposed rearwardly of the first pivot axis, and an operating lever connected to one end of said drive shaft and operable so as to drive rotation of said drive shaft about the shaft axis;

a linkage device interconnecting said drive shaft and said leg rest frame, said linkage device being responsive to rotation of said drive shaft so as to drive movement of said leg rest frame from one of the folded and unfolded positions to the other of the folded and unfolded positions; and a back frame mounted on and extending upwardly from said base frame unit;

wherein said base frame unit further includes a support frame, said seat frame being mounted movably on said support frame and being movable between front and rear frame positions on said support frame, said back frame having a lower frame section connected pivotally to said rear frame portion of said seat frame and pivotable relative to said seat frame about a second pivot axis parallel to said first pivot axis, and an upper frame section connected pivotally to said support frame and pivotable relative to said support frame about a third pivot axis disposed above and parallel to the second pivot axis, wherein movement of said back frame from an upright position to a tilted position relative to said support frame in response to pressure applied on said back frame results in corresponding movement of said seat frame from the rear frame position to the front frame position.

* * * * *